US007849890B2

(12) United States Patent
Jones

(10) Patent No.: US 7,849,890 B2
(45) Date of Patent: Dec. 14, 2010

(54) APPARATUS FOR AND METHODS OF DRAINING AN ENCLOSURE

(75) Inventor: Allen Jones, Beaufort, NC (US)

(73) Assignee: Lockheed Martin Corporation, Bethesda, MD (US)

( * ) Notice: Subject to any disclaimer, the term of this patent is extended or adjusted under 35 U.S.C. 154(b) by 381 days.

(21) Appl. No.: 11/173,622

(22) Filed: Jul. 1, 2005

(65) Prior Publication Data

US 2007/0000564 A1 Jan. 4, 2007

(51) Int. Cl.
*G08B 21/20* (2006.01)

(52) U.S. Cl. ..... 141/198; 141/1; 141/65; 141/94; 141/302; 137/2; 137/389; 236/44 A; 340/618

(58) Field of Classification Search ..... 137/2, 137/392, 389, 386, 395–396; 141/1, 65, 141/83, 94, 95, 198, 302; 236/44 A; 340/612, 340/618

See application file for complete search history.

(56) References Cited

U.S. PATENT DOCUMENTS 3,285,181 A * 11/1966 Howard ..... 137/558
3,741,683 A * 6/1973 McTamaney et al. ..... 137/392
3,787,733 A * 1/1974 Peters ..... 307/118
4,080,247 A 3/1978 Malakul
4,275,382 A * 6/1981 Jannotta ..... 340/870.16
4,388,768 A 6/1983 Sanderson
4,437,811 A * 3/1984 Iwata et al. ..... 417/8
4,551,068 A * 11/1985 Boudreaux ..... 137/392
4,574,829 A * 3/1986 Cummings et al. ..... 137/195
4,612,949 A 9/1986 Henson
4,652,802 A * 3/1987 Johnston ..... 137/395
4,779,640 A * 10/1988 Cummings et al. ..... 137/195
5,038,268 A 8/1991 Krause et al.
5,043,143 A * 8/1991 Shaw et al. ..... 422/65
5,078,577 A * 1/1992 Heckman ..... 417/2
5,337,779 A * 8/1994 Fukuhara ..... 137/187
5,909,352 A * 6/1999 Klabunde et al. ..... 361/191
6,026,837 A * 2/2000 Chen ..... 137/2
6,209,753 B1 4/2001 Ohu
6,237,627 B1 * 5/2001 Boule ..... 137/571
6,322,325 B1 * 11/2001 Belehradek ..... 417/2
6,349,554 B2 2/2002 Patel et al.
6,565,325 B2 * 5/2003 Belehradek ..... 417/2
6,585,168 B1 7/2003 Caprio
6,868,683 B2 * 3/2005 Bash et al. ..... 62/180
6,945,274 B1 * 9/2005 Davis ..... 137/624.11
6,970,079 B2 * 11/2005 Sabatino ..... 137/551
7,043,933 B1 * 5/2006 Knight ..... 62/259.2
7,218,237 B2 * 5/2007 Kates ..... 137/312
7,306,654 B2 * 12/2007 King et al. ..... 95/224
2003/0116191 A1 * 6/2003 Dobies et al. ..... 137/204
2003/0122323 A1 * 7/2003 Tahir et al. ..... 277/630
2004/0007264 A1 * 1/2004 Bootka ..... 137/312
2004/0041036 A1 * 3/2004 Acker, Jr. ..... 236/44 A
2004/0256409 A1 * 12/2004 Proulx ..... 222/64
2007/0258827 A1 * 11/2007 Gierke ..... 417/6

* cited by examiner

*Primary Examiner*—Gregory L Huson
*Assistant Examiner*—Nicolas A Arnett
(74) *Attorney, Agent, or Firm*—Kevin D. Jablonski; Graybeal Jackson LLP

(57) ABSTRACT

An assembly includes a sensor element operable to generate a signal in response to moisture being present at a predetermined level within a sealed housing, and a valve element coupled to the housing and, in response to the signal, operable to enable at least a portion of the moisture to exit the housing.

18 Claims, 2 Drawing Sheets

APPARATUS FOR AND METHODS OF DRAINING AN ENCLOSURE

BACKGROUND

Modern ships and other waterborne vessels typically employ sensitive electronic equipment to facilitate navigational, propulsive and other functions. Ideally, this equipment is disposed in a watertight enclosure, such as a cabinet or other container, to protect the equipment from being damaged by water.

Often, however, moisture nonetheless accumulates in the watertight enclosure. For example, the electronic equipment within the enclosure may require cooling. Consequently, pipes that deliver water or other liquid to cool the equipment may leak such liquid inside the enclosure. Additionally, because a watertight enclosure may not be airtight, humidity may enter the enclosure, and may condense into standing water within the enclosure.

In order to solve this moisture-accumulation problem, several methods of allowing or forcing the accumulated moisture to exit the enclosure have been attempted. One such method involves drilling or otherwise forming weep holes in the enclosure bottom to allow accumulated moisture to drain therefrom. But, an enclosure employing weep holes may no longer be sufficiently watertight for many applications.

Additionally, if the portion of the enclosure in which the weep holes are disposed becomes submerged or abuts the floor, gravity-based drainage of accumulated moisture may not be an option.

Moreover, although weep holes allow drainage, they typically cannot generate a signal that indicates a moisture accumulation problem within the enclosure.

SUMMARY

In an embodiment of the invention, an assembly includes a sensor element operable to generate a signal in response to moisture being present at a predetermined level within a sealed housing, and a valve element coupled to the housing and, in response to the signal, operable to enable at least a portion of the moisture to exit the housing.

DETAILED DESCRIPTION

Figure 1:
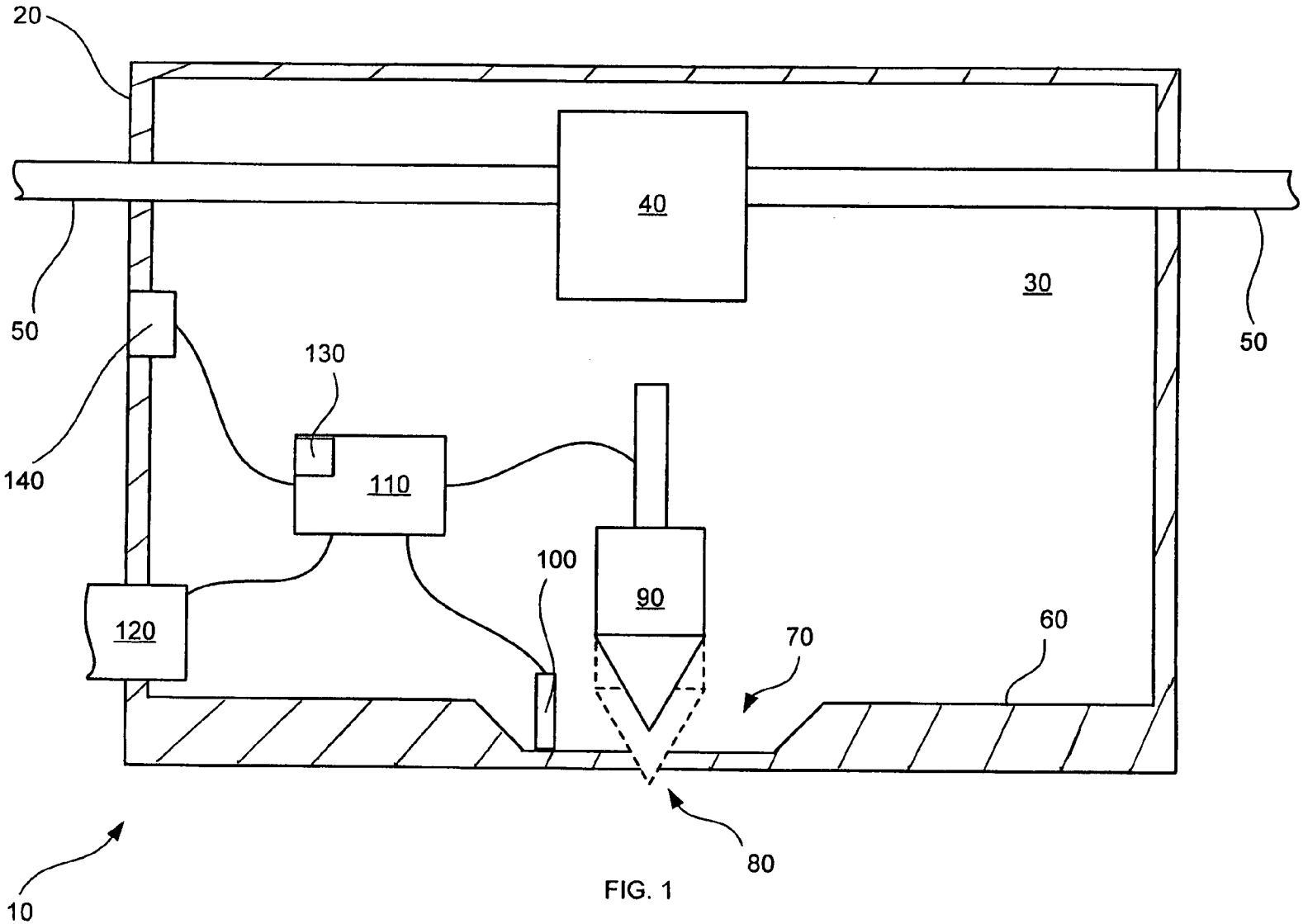
FIG. 1 is a schematic diagram in cross section of a system according to an embodiment of the invention.

FIG. 1 illustrates in cross-section a system 10 according to an embodiment of the invention. The system 10 includes a housing 20 that is sealed to prevent liquid from entering an interior chamber 30 of the housing. Device 40, which may include, for example, electronic circuitry, is disposed within the chamber 30. The housing 20 may be operable to receive pipes 50 that carry liquid for cooling the device 40.

As discussed above, water or other liquid, such as coolant, may undesirably accumulate within the housing 20. For example, the pipes 50 or housing 20 may develop a leak, or water may result from condensation of humidity within the housing 20. To allow the removal of such liquid, a floor portion 60 of the housing 20 is sloped in a manner that causes liquid in the chamber 30 to accumulate in a pooling recess 70 of the floor portion. An aperture 80, such as a weep hole, is formed in the pooling recess 70 and allows liquid to drain out of the chamber 30.

The system 10 further includes a valve element 90, such as a conventional poppet valve. Under ordinary operating conditions, the valve element 90, as indicated by the dashed lines in FIG. 1, is seated in a biased manner in and, consequently, seals off the aperture 80 to maintain watertight integrity of the housing 20.

A sensor element 100, such as a liquid sensor known in the art, is disposed in the pooling recess 70. The sensor element 100 may be calibrated to generate a signal when the liquid in the pooling recess 70 has accumulated to a first predetermined level. The signal generated by the sensor element 100 is received by a controller 110 that, in response to the signal, activates the valve element 90. Although shown disposed within the housing 20, the controller 110 may be disposed outside of the housing.

Upon activation by the controller 110, the valve element 90 retracts from its seating in the aperture 80, thereby allowing the liquid accumulated in the pooling recess 70 to drain from the chamber 30. The controller 110 reseats the valve in the aperture 80 once the sensor indicates to the controller that no more than a predetermined low level of liquid remains in the pooling recess 70. Alternatively, the controller 110 may reseat the valve after a predetermined period of time following retraction of the valve element 90, or in response to an external reset signal.

Additionally, and in a case in which, for example, the housing 20 is at least substantially airtight, the controller 110 may be equipped to determine the pressure within the chamber 30 as well as the pressure on the exterior of the housing 20 at the aperture 80. As such, if the exterior pressure exceeds the pressure inside the chamber 30, such as may be the case when the housing 20 is at least partially submerged in liquid, the controller 110 may determine that drainage via the aperture 80 is not possible. Consequently, upon receiving the signal from the sensor, the controller 110 may activate a pump 120 operable to actively expel the liquid accumulated in the pooling recess 70 from the chamber 30 via one or more pipes (not shown).

In addition, and in a case in which, for example, the housing 20 is at least substantially airtight, the controller 110 may include a humidity sensor element 130. Accordingly, if the humidity within the chamber 30 exceeds a first predetermined humidity level, the controller 110 may activate a ventilation system 140, such as a fan, that allows the expulsion of liquid vapor out of the chamber 30. The ventilation system 140 is watertight when not expelling vapor from the chamber 30.

Figure 2:
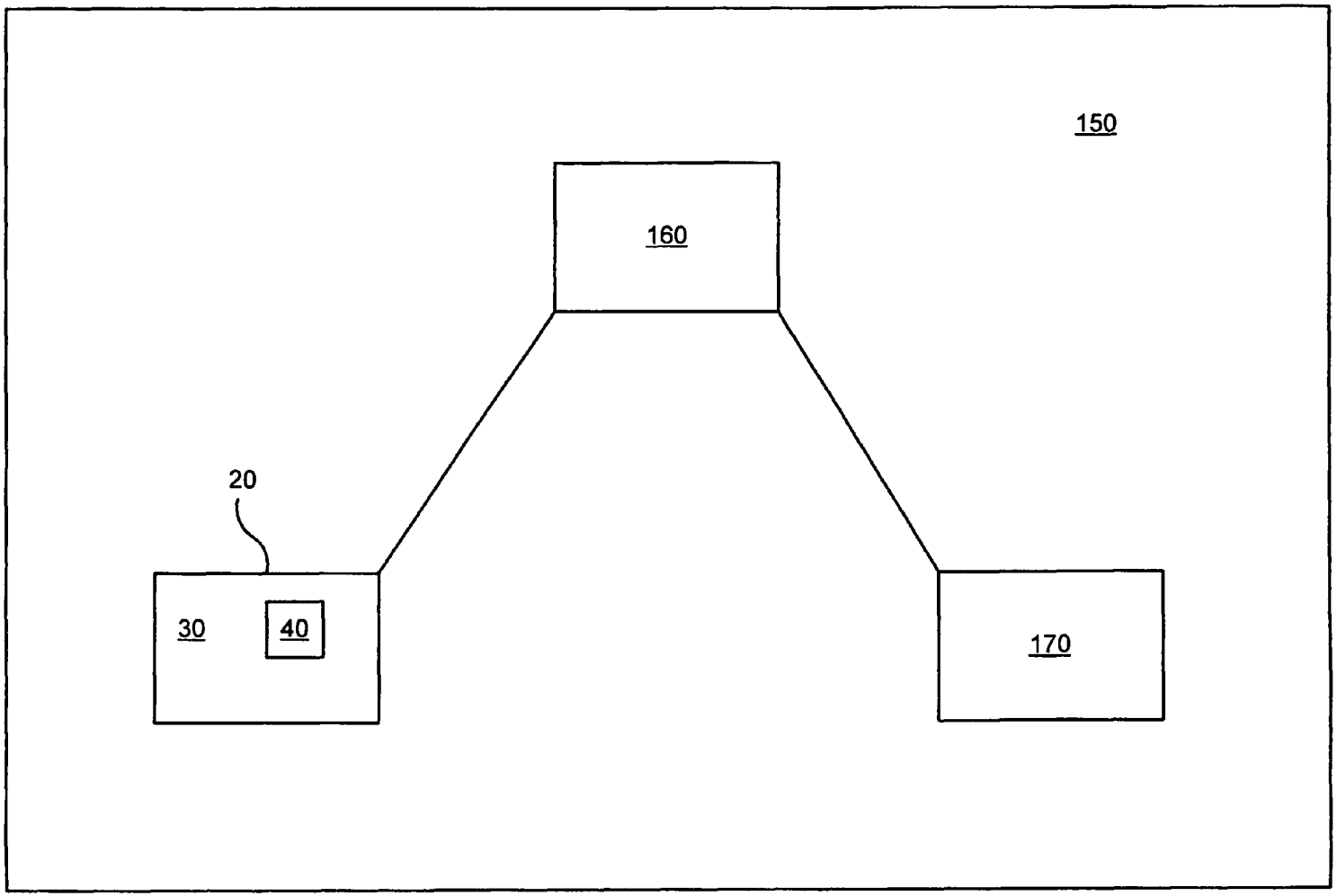
FIG. 2 is a block diagram of a vessel incorporating the system of FIG. 1 according to an embodiment of the invention.

Referring now to FIG. 2, shown is a vessel 150, such as a surface ship or submarine, that includes a control center 160, which may include a computer system, coupled to the device 40 within the watertight housing 20 of FIG. 1, and a subsystem 170 according to an embodiment of the invention. The device 40 and subsystem 170 may be electronic systems, such as computer systems, that control certain aspects of the operation of the vessel 150.

As discussed above with reference to FIG. 1, if one or more sensor elements within the housing 20 detect the presence of moisture in the chamber 30 at a first predetermined level, the controller 110 is operable to ensure that the excess moisture is expelled from the chamber 30. The signal(s) provided to the controller 110 by the one or more sensor element(s) 100 may duplicatively be issued to the control center 160 so as to inform, via lights, alarms, or other conventional alerting means, an operator (not shown) of the control center 160 itself that excess moisture has accumulated in the chamber 30. Alternatively, the sensor element(s) 100 may not issue a signal to the control center 160 until liquid and/or the humidity level present in the chamber 30 reaches a second predetermined level greater than the aforementioned first predetermined levels.

Once the signal is received at the control center 160, a variety of responses may be executed by the control center to resolve problems associated with moisture or liquid accumulating inside the chamber 30. For example, the control center 160 may respond by discontinuing power supplied to the device 40. Because the functions performed by the device 40 may be critical to operation of the vessel 150, the control center 160 may further respond by transferring responsibility for the functions of the device 40 to the subsystem 170. Additionally, the control center 160 may respond by checking the flow/pressure parameters of, and/or reducing or discontinuing the flow of cooling fluid entering the housing 20 via the pipes 50. In addition, if the control center 160 reduces or halts the flow of coolant into and/or out of the housing 20, then the control center may modify operation of the device 40 to reduce heat generated by the device such that the device can continue operation with the reduced or nonexistent coolant flow. Thus, the control center 160 may prevent a catastrophic failure of the device 40, and may allow the vessel 150 to remain fully functional (by transferring the functions of the device 40 to the device 170) while the housing 20 is repaired or replaced.

The preceding discussion is presented to enable a person skilled in the art to make and use the invention. Various modifications to the disclosed embodiments will be readily apparent to those skilled in the art, and the generic principles herein may be applied to other embodiments and applications without departing from the spirit and scope of the invention. Thus, the invention is not intended to be limited to the embodiments shown, but is to be accorded the widest scope consistent with the principles and features disclosed herein.

What is claimed is:

1. An assembly, comprising:

a sealed housing;

at least one moisture-sensitive component disposed of within the sealed housing;

a first sensor element operable to generate a first signal in response to moisture in a first state being present at a first predetermined level within the sealed housing;

a first valve element coupled to the housing and, in response to the first signal, operable to enable at least a portion of the moisture to exit the housing at the first valve element;

a second sensor element operable to generate a second signal in response to moisture in a second state being present at a second predetermined level within the sealed housing;

a third sensor element operable to sense that a pressure outside the housing is less than a pressure within the housing; and a second valve element coupled to the housing and, in response to the second signal, operable to enable at least a portion of the moisture to exit the sealed housing at the second valve element if and only if the pressure level inside the sealed housing is greater than a pressure level outside the sealed housing.

2. The assembly of claim 1 wherein the second signal is generated in response to a humidity level within the housing.

3. The assembly of claim 1 wherein the predetermined level comprises a liquid level.

4. The assembly of claim 1 wherein the first valve element comprises a poppet valve.

5. The assembly of claim 1 wherein the second valve element comprises a pump.

6. The assembly of claim 1 wherein the second valve element comprises a vent.

7. The assembly of claim 1 wherein the second sensor element is further operable to generate a third signal in response to moisture being present at the second predetermined level within the housing.

8. The assembly of claim 7 wherein the third signal is operable to cause a device to inform an operator that moisture is present at the second predetermined level within the housing.

9. The assembly of claim 7 wherein the third signal is operable to cause a discontinuation of power supplied to a device within the housing.

10. The assembly of claim 7 wherein the third signal is operable to enable operation of a device exterior to the housing.

11. The assembly of claim 7 wherein the third signal is operable to cause a discontinuation of coolant supplied to the housing.

12. The assembly of claim 7 wherein the second predetermined level is greater than the first predetermined level.

13. A vessel, comprising:

a first system, comprising:

a sealed housing;

at least one moisture-sensitive component disposed of within the sealed housing;

a first sensor element operable to generate a first signal in response to liquid being present at a first predetermined level within the housing;

a first valve element coupled to the housing and, in response to the first signal, operable to enable at least a portion of the liquid to exit the housing via the first valve element;

a second sensor element operable to generate a second signal in response to vapor being present at a second predetermined level within the housing;

a third sensor element operable to generate a third signal in response to a pressure level inside the housing being greater than a pressure level outside the housing; and a second valve element coupled to the housing and, in response to the second signal and the third signal, operable to enable at least a portion of the vapor to exit the housing via the second valve element.

14. The vessel of claim 13, further comprising:

an electronic device disposed within the housing and operable to perform a function; and a second system operable to discontinue power supplied to the electronic device.

15. The vessel of claim 14 wherein the second system is operable to discontinue the supplied power in response to the first signal.

16. The vessel of claim 14, further comprising a third system, wherein the second system is further operable, in response to the first signal, to cause the third system to perform the function.

17. A method, comprising:

generating a first signal in response to moisture in a first state being present at a first predetermined level within a sealed housing having at least one moisture-sensitive component disposed of within the sealed housing;

in response to the first signal, causing a first valve element to enable at least a portion of the moisture to exit the housing;

sensing that a pressure outside the housing is less than a pressure within the housing;

generating a second signal in response to moisture in a second state being present at a first predetermined level within a sealed housing; and in response to the second signal and the pressure sensing, causing a second valve element to enable at least a portion of the moisture to exit the housing.

18. The method of claim 17, further comprising generating a third signal in response to moisture in the second state being present at a second predetermined level within the housing.

* * * * *